US007775348B2

(12) United States Patent
Olsen et al.

(10) Patent No.: US 7,775,348 B2
(45) Date of Patent: Aug. 17, 2010

(54) DIVISIBLE CONTAINER CARRIER

(75) Inventors: Robert Olsen, Medinah, IL (US); Leslie Marco, Westmont, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/789,165

(22) Filed: Apr. 24, 2007

(65) Prior Publication Data

US 2007/0193889 A1 Aug. 23, 2007

Related U.S. Application Data

(63) Continuation-in-part of application No. 11/349,571, filed on Feb. 8, 2006, now Pat. No. 7,445,114.

(51) Int. Cl.
*B65D 75/00* (2006.01)

(52) U.S. Cl. ..... 206/150; 294/87.2

(58) Field of Classification Search ..... 206/145, 206/147, 150, 151, 170, 427; 294/87.2
See application file for complete search history.

(56) References Cited

U.S. PATENT DOCUMENTS

| | | | | |
|---|---|---|---|---|
| 2,098,090 | A | 11/1937 | Ford | |
| 3,038,602 | A | 6/1962 | Rapata | |
| 3,085,682 | A | 4/1963 | Poupitch | |
| 3,086,651 | A | 4/1963 | Poupitch | |
| 3,314,712 | A | 4/1967 | Hohl et al. | |
| 3,515,272 | A | 6/1970 | Von Gal | |
| 3,664,497 | A * | 5/1972 | Mascia | 206/151 |
| 3,734,278 | A | 5/1973 | Kerrigan et al. | |
| 3,784,003 | A | 1/1974 | Bolton | |
| 4,018,331 | A | 4/1977 | Klygis | |
| 4,149,631 | A * | 4/1979 | Cunningham | 206/150 |
| 4,232,807 | A | 11/1980 | Beier et al. | |
| 4,269,308 | A | 5/1981 | Platt | |
| 4,385,691 | A | 5/1983 | Klygis | |
| 4,487,312 | A | 12/1984 | Heider | |
| 4,518,081 | A | 5/1985 | de Larosiere | |

(Continued)

FOREIGN PATENT DOCUMENTS

| | | |
|---|---|---|
| DE | 11 95 024 | 6/1965 |

(Continued)

OTHER PUBLICATIONS

Co-pending U.S. Appl. No. 11/349,571, filed Feb. 8, 2006, entitled "Divisible Container Carrier".

*Primary Examiner*—Luan K Bui
(74) *Attorney, Agent, or Firm*—Pauley Petersen & Erickson

(57) ABSTRACT

A flexible carrier for carrying a plurality of containers includes a flexible sheet having two rows of container apertures formed therein. The plurality of containers are each placed into a respective container receiving aperture and are thus unitized in a package. The flexible carrier further includes two panels and/or two handles, each panel and/or handle formed at a periphery of the flexible sheet along each longitudinal edge of the flexible sheet and a line of weakness formed between the longitudinal rows. As a result of the described configuration, flexible carrier is divisible into two sub-carriers, each unitizing a set of containers and each including a panel and/or a handle along a respective longitudinal edge of the resulting sub-carrier.

13 Claims, 6 Drawing Sheets

U.S. PATENT DOCUMENTS

| | | | |
|---|---|---|---|
| 5,018,620 | A | 5/1991 | Marco et al. |
| 5,038,928 | A | 8/1991 | Marco et al. |
| 5,072,829 | A | 12/1991 | Marco et al. |
| 5,261,530 | A | 11/1993 | Marco |
| 5,535,879 | A | 7/1996 | Appleton |
| 5,544,749 | A | 8/1996 | Watts |
| 5,651,453 | A | 7/1997 | Olsen |
| 5,653,334 | A | 8/1997 | Marco |
| 5,868,659 | A | 2/1999 | Slomski |
| 6,182,821 | B1 | 2/2001 | Olsen |
| 7,100,762 | B2 | 9/2006 | Marco |
| 2005/0279650 | A1 | 12/2005 | Marco |

FOREIGN PATENT DOCUMENTS

| | | |
|---|---|---|
| EP | 0507479 | 10/1992 |
| EP | 0514108 | 11/1992 |
| EP | 0728674 | 8/1996 |
| EP | 1 004 518 | 5/2000 |
| EP | 1 077 184 | 2/2001 |
| WO | WO 2005/110886 | 11/2005 |
| WO | WO 2007/092309 | 8/2007 |

* cited by examiner

DIVISIBLE CONTAINER CARRIER

CROSS REFERENCE TO RELATED APPLICATION

This application is a continuation-in-part of prior U.S. application Ser. No. 11/349,571, filed 8 Feb. 2006, now U.S. Pat. No. 7,445,114. The parent patent is hereby incorporated by reference herein in its entirety and is made a part hereof, including but not limited to those portions which specifically appear hereinafter.

BACKGROUND OF THE INVENTION

1. Field of the Invention

This invention relates to a flexible carrier for carrying a plurality of containers such as cans or bottles.

2. Description of Prior Art

Conventional container carriers are often used to unitize a plurality of similarly sized containers, such as cans, bottles, jars and boxes and/or similar containers that require unitization. Flexible plastic ring carriers are one such conventional container carrier.

Flexible plastic ring carriers may be used to unitize groups of four, six, eight, twelve or other suitable groups of containers into a convenient multi-package. One problem encountered with conventional multi-packages, such as six packs and twelve packs, is a lack of flexibility for the merchandiser. If the merchandiser stocks only six packs, then the consumer cannot purchase a smaller package. This merchandising problem is especially acute for smaller, low-volume merchandisers which do not have the shelf space or the inventory capabilities to stock multiple sizes of multi-packages.

Merchandisers have attempted several solutions of the above problem. Some merchandisers use a utility knife to cut multi-packages into smaller sub-packages, resulting in an unstable package, generally without an effective handle for the consumer. Some merchandisers purchase multiple cardboard flats of loose containers and re-package the containers on the premises according to demand. This procedure is time consuming and also results in unstable and inconsistent multi-packages.

Both of the above inadequate solutions also result in multi-packages that must be re-priced according to the size of the multi-package. Often universal bar code ("UPC") symbols, bar codes or other means of pricing reflect the price of the previously sized multi-package, thus resulting in improper scans and incorrect labeling of the re-packaged multi-package.

A corollary problem faced by bottlers is applicating machines designed for large multi-packages of, for instance, 8 or 12 containers often do not meet the needs of the merchandisers. Therefore, a need exists to accommodate the equipment used to assemble larger sized multi-packages and yet still provide merchandisers with multi-packages having containers in smaller multiples.

SUMMARY OF THE INVENTION

The present invention is directed to a flexible carrier for packaging containers that includes an arrangement of container apertures that are divisible along a line of weakness. A pair of handles and/or panels are preferably positioned along opposite edges of the flexible carrier for grasping the carrier and/or providing billboard space from a longitudinal edge of the resulting package.

According to preferred embodiments of this invention, each flexible carrier preferably includes two rows of container apertures, each for receiving a container, to form a package. A severable line of weakness extends between the rows of container apertures that may be separated by the bottler subsequent to application or the retailer prior to sale. Each resulting sub-carrier preferably forms a self-contained multi-package with a discrete handle for carrying the sub-carrier and/or panel for billboard space and providing a discrete labeling system for correct scanning of the resulting multi-package.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
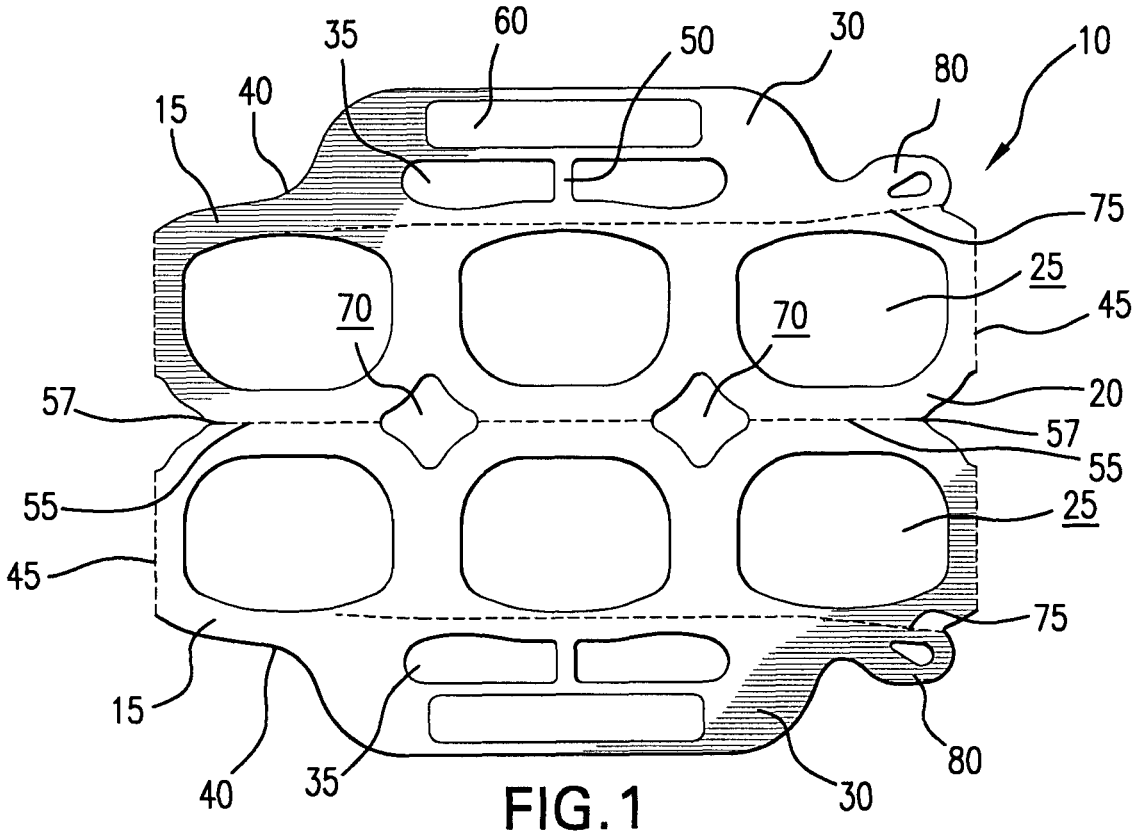
FIG. 1 is a top view of a flexible carrier according to one preferred embodiment of this invention.
Figure 2:
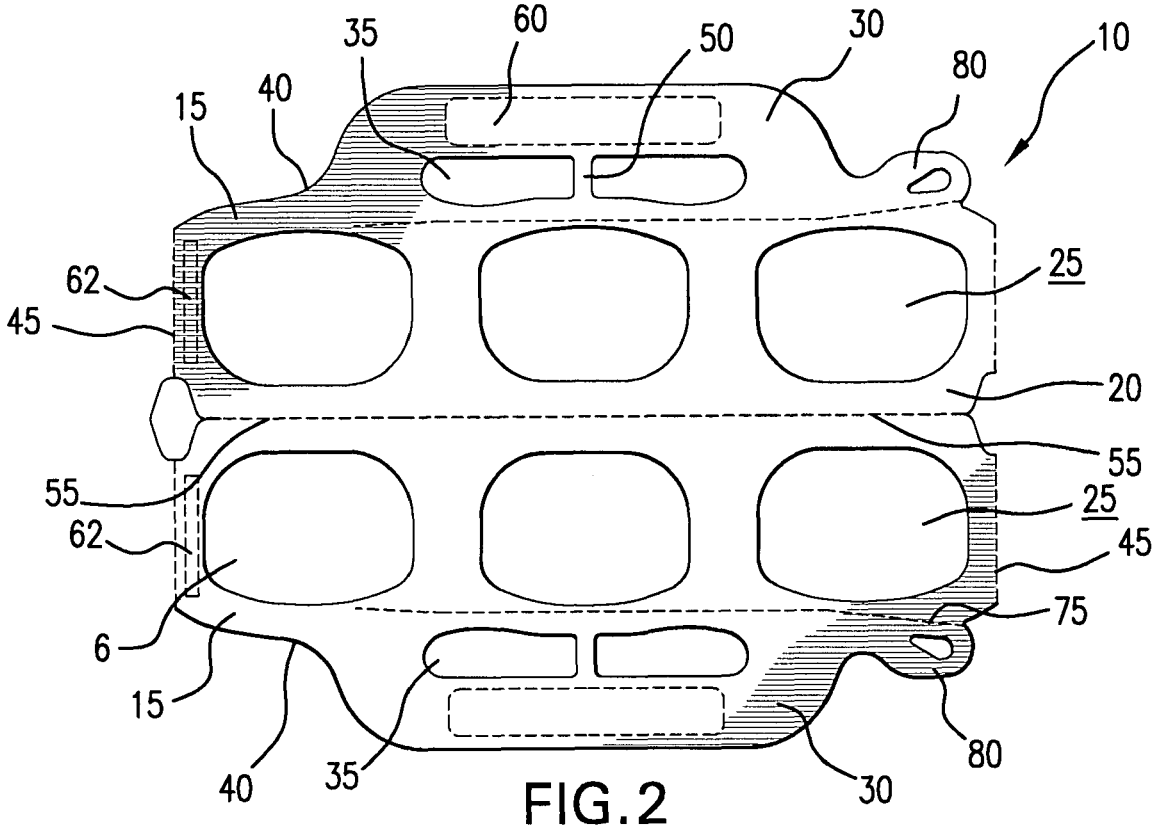
FIG. 2 is a top view of a flexible carrier according to one preferred embodiment of this invention.
Figure 3:
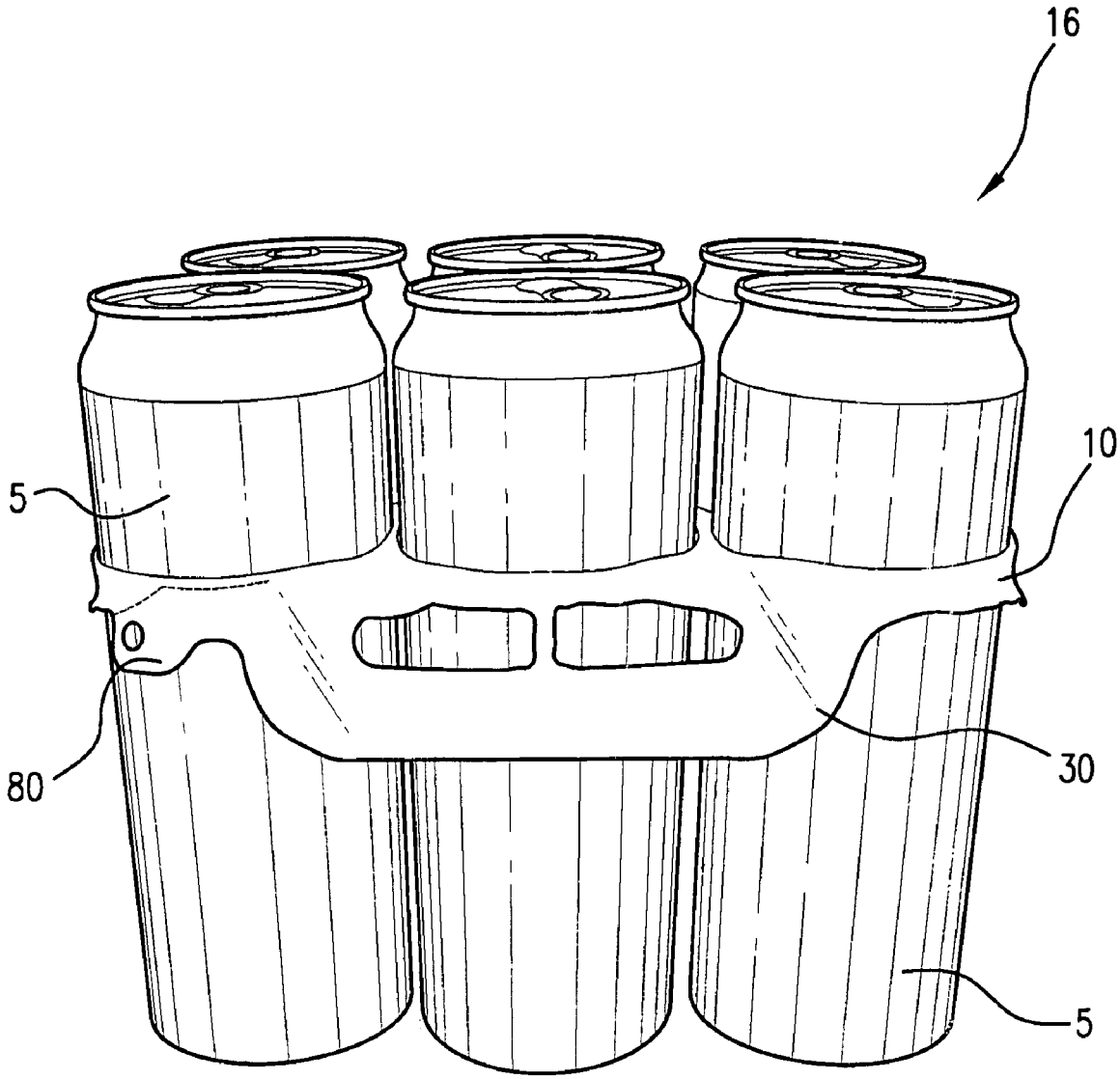
FIG. 3 is a side view of a package according to one preferred embodiment of this invention.
Figure 4:
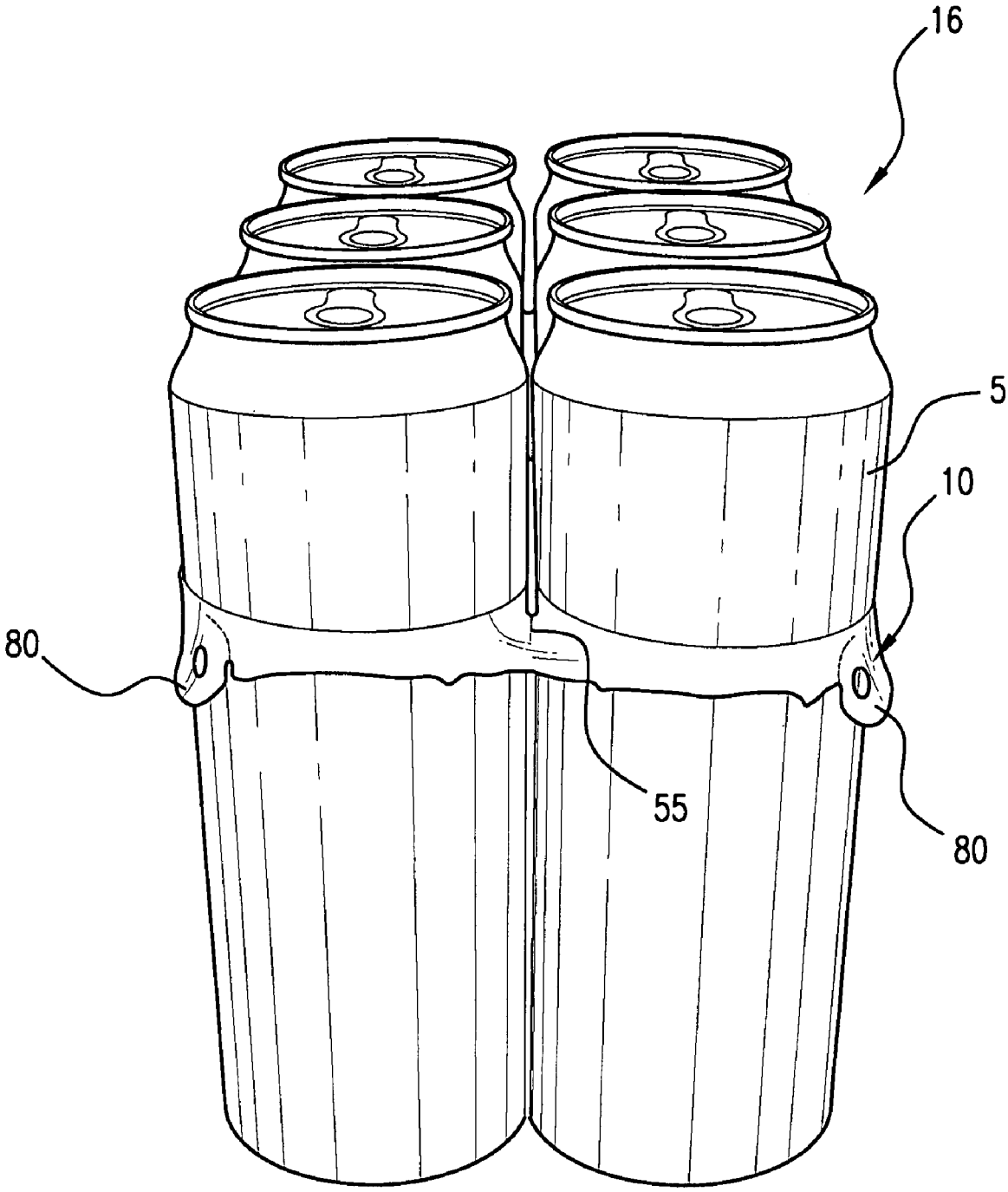
FIG. 4 is a front view of the package shown in FIG. 3.
Figure 5:
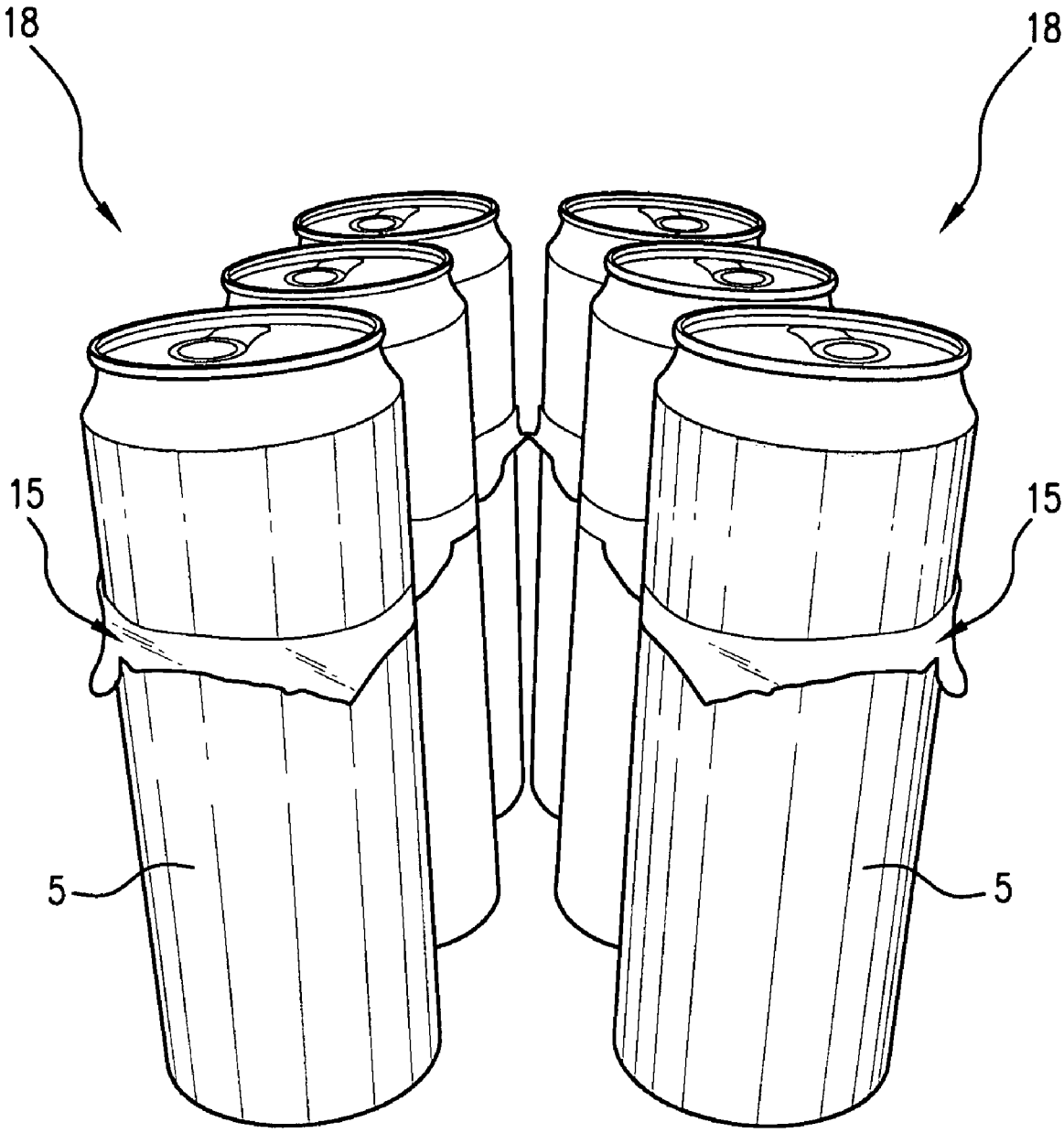
FIG. 5 is a front view the package shown in FIG. 3 showing the package partially divided into two sub-packages.
Figure 6:
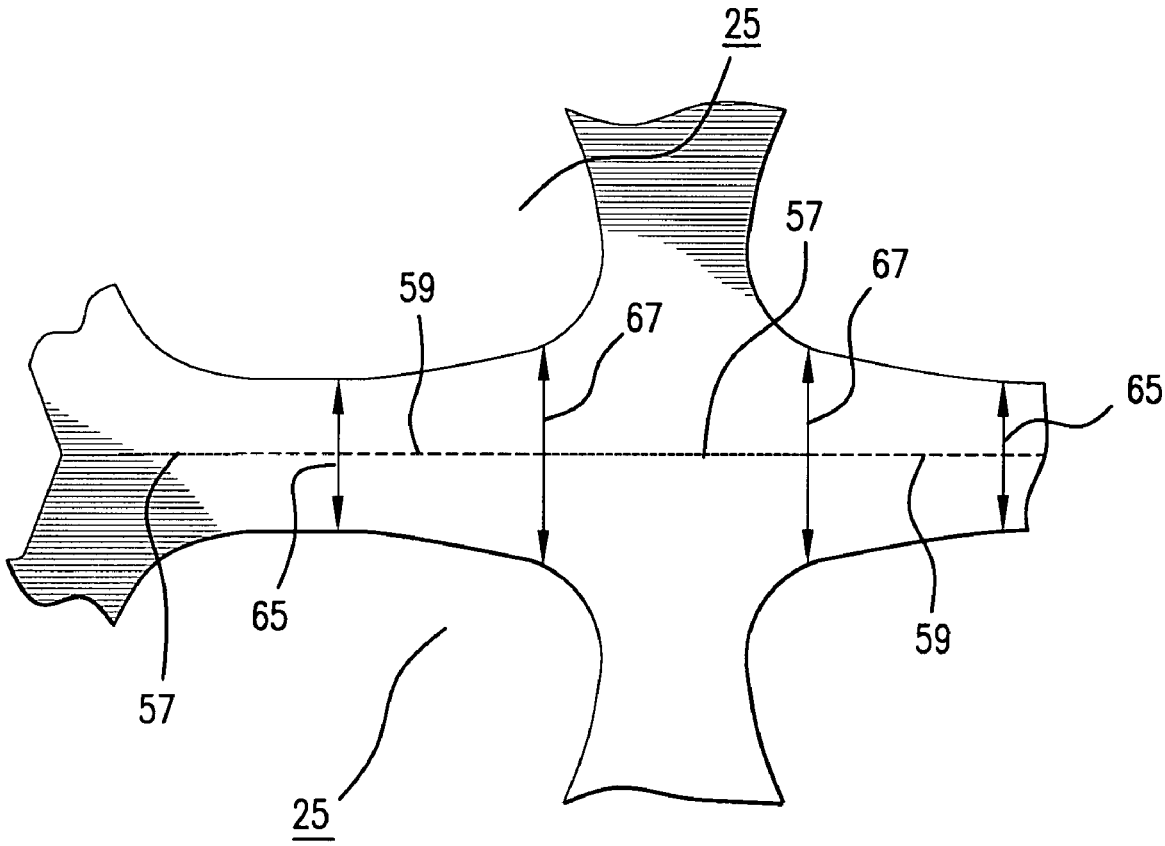
FIG. 6 is a magnified view of a portion of the carrier shown in FIG. 2.
Figure 7:
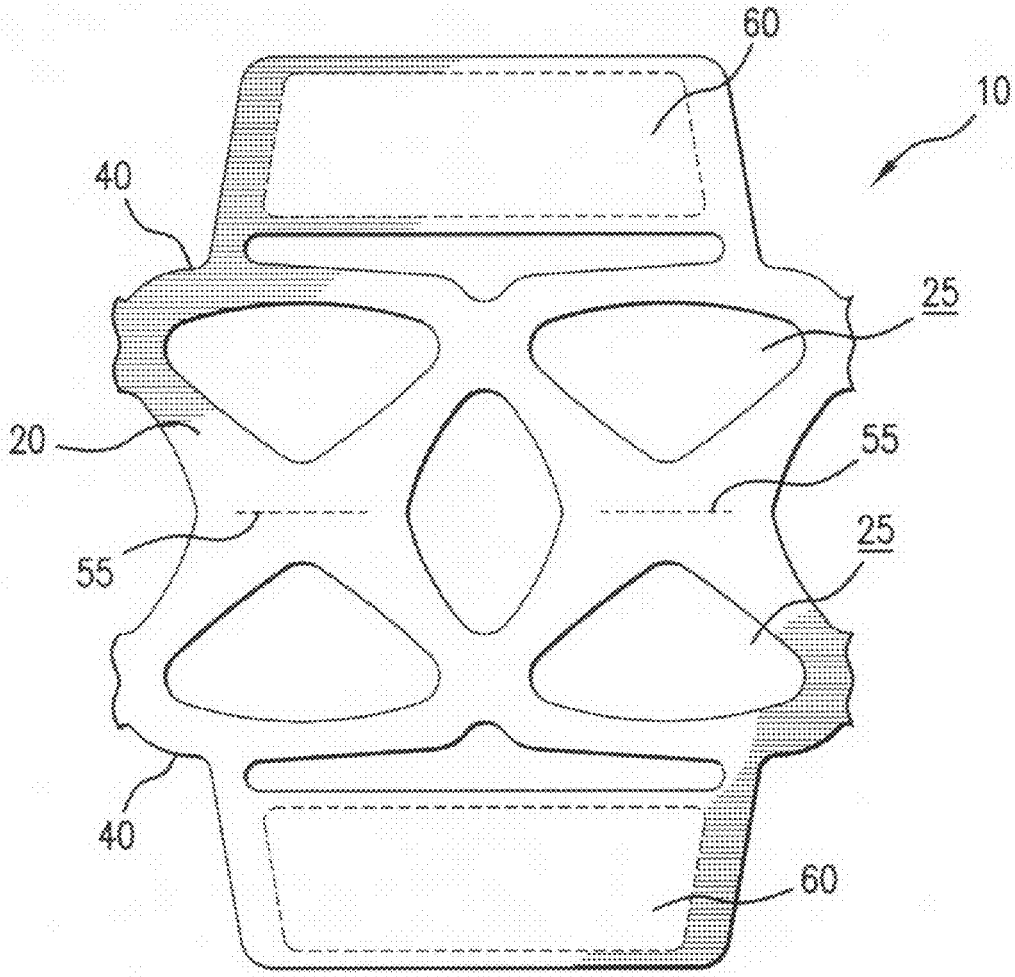
FIG. 7 is a top view of a flexible carrier according to one preferred embodiment of this invention.

FIGS. 1-6 show flexible carrier 10 for unitizing six containers to form a unitized package. Although FIGS. 1 and 2 illustrate various structures for flexible carrier 10 of the invention, the illustrations are exemplary, and the invention is not limited to the flexible carriers 10 shown. FIGS. 3-5 show package of six containers 5. However, flexible carrier 10 may be configured and used to unitize four containers such as shown in FIG. 7, eight containers, twelve containers or any other desired number of containers 5.

Carrier 10 is used to unitize a plurality of appropriate containers 5, preferably cans or bottles. However, any other commonly unitized container may be used with flexible carrier 10 according to this invention. Containers 5 are preferably like-sized within a single flexible carrier 10.

Package 16 resulting from flexible carrier 10 includes a plurality of unitized containers 5. Flexible carriers 10 are generally applied to such containers 5 by stretching flexible sheet 20 surrounding container apertures 25 around a perimeter of the container, and allowing the stretched carrier 10 to recover, thereby providing a tight engagement. Flexible carrier 10 is typically applied to a chime or rib of container 5, where this structure exists, or to a main sidewall, such as shown in FIGS. 3-5.

Each flexible carrier 10 preferably includes flexible sheet 20 having a width and length defining therein a plurality of container apertures 25, each for receiving container 5. The plurality of container apertures 25 are preferably arranged in longitudinal rows and longitudinal ranks so as to form an array of container apertures 25, such as two rows by three ranks for a six container multi-package; two rows by six ranks for a twelve container multi-package, etc. Container apertures 25 are preferably elongated in a longitudinal direction of flexible carrier 10.

As shown in FIGS. 1 and 2, flexible carrier 10 further includes two handles 30, each handle 30 formed at a periphery of flexible sheet 20 along each longitudinal edge 40 of flexible sheet 20. Each handle 30 is preferably suitable for manual grasping and extends from each longitudinal edge 40 to permit carrying of package 16 formed by flexible carrier 10 and the plurality of containers 5.

Handle 30 is preferably positioned relative to flexible sheet 20 so as to extend from a periphery of flexible sheet 20, along a longitudinal edge 40 of flexible sheet. Handle 30 preferably extends from each longitudinal edge 40 of flexible carrier 10 thereby forming two handles 30 positioned with respect to flexible carrier 10. Specifically, handle 30 may be integrally formed with flexible sheet 20 or may comprise a separately formed and affixed feature of flexible carrier 10.

Handle 30 may comprise one or more elongated handle apertures 35 positioned along the outer periphery of handle 30 or may comprise a similar configuration that provides an ample area for a consumer to grasp, by inserting a hand within and through, and still maintain the purpose and integrity of the resulting package. Handle 30 preferably forms handle aperture 35 within flexible carrier 10 and, as described in more detail below, is capable of supporting the weight of the resulting package when grasped by a consumer. As a result of the configuration of handle 30 relative to flexible sheet 20, including handle aperture 35 it should be apparent to a consumer that handle 30 is intended for grasping and lifting of the package.

According to one preferred embodiment of this invention, handle strut 50 extends through handle aperture 35 to severably connect handle 30 with longitudinal edge 40 of carrier 10. Handle strut 50 may be severed from handle 30 and/or flexible sheet 20 to permit free access to handle 30. Such an initial configuration of handle strut 50 helps maintain a position of handle 30 at each longitudinal edge 40 of flexible carrier 10, which is especially beneficial when coiling and uncoiling a generally continuous string of flexible carriers 10 on to and off of a production reel.

As best shown in FIG. 1, according to one preferred embodiment of this invention, panel 60 is preferably formed within handle 50. Panel 60 preferably accommodates, on one or both sides, UPC, bar codes and/or proof of purchase labels, graphics, and promotional and/or other information related to contents and/or ingredients of the containers and/or the package. In addition, as shown in FIG. 2, one or more sub-panels 62 may be positioned at outer edges 45 of carrier 10 to provide redundant or additional information.

Flexible carrier 10 further includes line of weakness 55 formed between the longitudinal rows of container apertures 25 in what is commonly called the machine direction of flexible carrier 10, i.e., parallel to the direction in which flexible carrier 10 is extruded and punched into form. Line of weakness 55 may comprise a perforation, slits, a thickness reduction in flexible sheet 20 or any other suitable weakening of flexible carrier 10 that permits separation of flexible sheet 20 into two or more sub-carriers 15. According to a preferred embodiment of this invention, as flexible carrier 10 is applied to groups of containers, flexible sheet 20 and surrounding container apertures 25 are stretched around a perimeter of the container in a transverse direction, perpendicular to the machine direction, without breaking line of weakness 55 positioned between such container apertures 25.

According to one preferred embodiment of this invention, line of weakness 55 comprises an intermittent perforation extending from near one outer edge 45 of flexible sheet 20 to near an opposite outer edge 45 of flexible sheet 20 and between the longitudinal rows of container apertures 25. As used herein, an "intermittent" perforation comprises a non-uniform perforation such as one that is interrupted by separation apertures 70 or one that alternates between and/or among differently sized perforations. As shown in FIGS. 2 and 6, flexible carrier 10 is thereby divisible along the intermittent perforation into two sub-carriers 15 each forming a sub-array of container apertures 25, as shown, three container apertures 25 in a row or a one by three array. FIG. 5 shows package 16 divided into two sub-packages 18.

As shown in FIG. 1, line of weakness 55 may comprise a generally homogeneous set of perforations formed between separation apertures 70 formed in flexible carrier 10 between rows of container apertures 25. As such, flexible carrier 10 may be separated by pulling apart the two rows of container apertures 25 thereby permitting the line of weakness 55 to separate up to the separation aperture 70 whereupon another set of perforations separates until flexible carrier is divided into two sub-carriers 15. According to a preferred embodiment of this invention, particularly in the embodiment of flexible carrier 10 shown in FIG. 1, nick 57 is formed in on or both outer edges 45 of flexible carrier 10 to assist in separating line of weakness 55. Nick 57 is preferably formed during a secondary operation, such as with a reciprocating blade, following application of carrier 10 to the plurality of containers.

Alternatively, as shown in FIG. 2, line of weakness 55 comprises an alternating perforation formed by a series of short perforations 57 and/or a series of long perforations 59. According to one preferred embodiment of this invention, alternating perforation, best shown in FIG. 6, comprises a series of short perforations 57 alternating with a series of long perforations 59. According to this embodiment, flexible carrier 10 may be separated by pulling apart the two rows of container apertures 25 across the series of short perforations 57 followed by separation of the series of long perforations 59. A reduced force is required to separate the long perforations 59 as a result of the momentum of separating the short perforations 57 easing and assisting this subsequent separation. This is important in that the combination of the two different perforation prevents carrier 10 from shearing at an angle into container apertures 25 as it is pulled and separated.

As described above, separation of line of weakness 55 may be performed in-process and automatically, such as by a blade or wedge or may be performed manually, either immediately after application or downstream in the product distribution cycle.

As best shown in FIG. 6, according to one preferred embodiment of this invention, a distance between transversely adjacent container apertures 25 may taper away from each other as line of weakness 55 transitions between short perforations 57 and long perforations 59. As shown, first distance 65 is preferably narrower between transversely adjacent container apertures 25 where such container apertures 25 are divided by long perforations 59. Second distance 67 is preferably wider between transversely adjacent container apertures 25 where such container apertures are divided by a transition from long perforations 59 to short perforations 57. Such a configuration permits separation along line of weakness 55 without tearing carrier 10 in unwanted areas, such as between line of weakness 55 and container openings 25.

According to one preferred embodiment of this invention, flexible carrier 10 may further comprise tear strip 75 positioned along each row of container apertures 25. Tear strip 75 may comprise a perforation, serrations, slits or holes in flexible carrier 10 and is preferably tearable to permit removable of each container 5 from within each respective container opening 25. Pull tab 80 may be positioned to extend from tear strip 75 thus facilitating removal of the containers from flexible carrier 10. As shown in FIGS. 1 and 2, as tear strip 75 further results in removal of handle 30 as each container is removed from each sub-carrier 15.

According to a preferred method of operation of the subject flexible carrier 10, a plurality of containers 5 are inserted within flexible carrier 10, preferably one container 5 in each carrier aperture 25. As described above, it is preferable that insertion of containers into flexible carrier 10 does not affect the integrity of line of weakness 55. As shown in FIGS. 1-3, six containers are positioned within the six container apertures 25 formed in flexible carrier 10 to form a unitized package 16. The resulting unitized package 16 may then be packed and shipped to a retailer or re-seller.

The retailer may then separate flexible carrier 10 and package 16 along line of weakness 55 into two or more sub-carriers 15 and sub-packages 18, such as shown in FIG. 5, each having a discrete handle 30 along a longitudinal edge of flexible carrier 10. As shown in FIGS. 1 and 2, flexible carrier 10 is separable into two sub-carriers 15 each accommodating three containers. Preferably, containers 5 are inserted within flexible carrier 10 resulting in package 16 shown in FIGS. 3 and 4. Package 16 is then dividable into two sub-packages 18 such as shown in FIG. 5. Each sub-carrier 15 and/or sub-package 18 preferably includes proper bar code or similar pricing and quantity information on the resulting panels 60 or sub-panels 62. The retailer may then sell the sub-carrier 15, for instance two packages of three containers, each grasped along a separate handle 30. A consumer may subsequently access individual containers by severing tear strip 75.

FIG. 7 shows an additional embodiment of flexible carrier 10 that includes flexible sheet 20 having a width and length defining therein four container apertures 25, each for receiving container 5. The plurality of container apertures 25 are preferably arranged in longitudinal rows and longitudinal ranks so as to form an array of container apertures 25, particularly two rows by two ranks for a four container multi-package. Container apertures 25 as shown are preferably generally triangular shaped.

As shown in FIG. 7, flexible carrier 10 further includes two panels 60, each panel 60 formed at a periphery of flexible sheet 20 along each longitudinal edge 40 of flexible sheet 20. Each panel 60 is suitable for labeling, graphics or other appropriate material generally desirable on a billboard space of flexible carrier 10.

According to a preferred method of operation of the subject flexible carrier 10, a plurality of containers 5 are inserted within flexible carrier 10, preferably one container 5 in each carrier aperture 25. As described above, it is preferable that insertion of containers into flexible carrier 10 does not affect the integrity of line of weakness 55. As shown in FIG. 7, four containers are positioned within the four container apertures 25 formed in flexible carrier 10 to form a unitized package.

According to one preferred embodiment of this invention, flexible carrier 10 may be automatically divided along line of weakness 55 during the application process, such as with a blade, knife or wedge. The result would thus include two retail two-packs each having panel 60. Such two-packs would then be palletized or otherwise packed and shipped to a retailer or re-seller.

Alternatively, the resulting unitized package of four containers may then be packed and shipped to a retailer or re-seller. The retailer may then separate flexible carrier 10 along line of weakness 55 into two sub-carriers, each having a discrete panel 60 along a longitudinal edge of flexible carrier 10.

As shown in FIG. 7, regardless of the timing of separation, flexible carrier 10 is separable into two sub-carriers each accommodating two containers. Each sub-carrier preferably includes proper bar code or similar pricing and quantity information on the resulting panels 60. The retailer may then sell the sub-carrier, for instance two packages of two containers.

While in the foregoing specification this invention has been described in relation to certain preferred embodiments thereof, and many details have been set forth for purpose of illustration, it will be apparent to those skilled in the art that flexible carrier 10 is susceptible to additional embodiments and that certain of the details described herein can be varied considerably without departing from the basic principles of the invention.

The invention claimed is:

1. A flexible carrier for carrying a plurality of containers, the flexible carrier comprising:

a flexible sheet;

an array of container apertures formed in the flexible sheet and arranged in longitudinal rows;

two panels, each panel approximately as wide as each container aperture of the array of container apertures and sized to accommodate billboard space for graphics and promotional information and formed at a periphery of the flexible sheet along each opposite longitudinal edge of the flexible sheet, the panels separated by the longitudinal rows, wherein a longitudinal direction extends in a machine direction of the flexible carrier; and a line of weakness formed between the longitudinal rows and dividing the flexible carrier into individual longitudinal rows, wherein the line of weakness separates into two sub-carriers, each sub-carrier including one of the individual longitudinal rows and one of the panels.

2. The flexible carrier of claim 1 wherein the line of weakness comprises:

an intermittent perforation extending from near one outer edge of the flexible sheet to near an opposite outer edge of the flexible sheet.

3. The flexible carrier of claim 2 wherein the intermittent perforation comprises a series of short perforations positioned between each adjacent pair of container apertures.

4. The flexible carrier of claim 1 wherein the line of weakness comprises a perforation followed by a separation aperture between the longitudinal rows.

5. The flexible carrier of claim 1 further comprising:

the two longitudinal rows of container apertures divisible along the line of weakness into the two sub-carriers each forming two container apertures.

6. The flexible carrier of claim 1, wherein the container apertures are generally triangular shaped.

7. A flexible carrier for carrying a plurality of containers, the flexible carrier comprising:

a flexible sheet having a plurality of container apertures formed therein and arranged in longitudinal rows, wherein a longitudinal direction extends in a machine direction of the flexible carrier;

two panels, each panel approximately as wide as each container aperture of the plurality of container apertures and sized to accommodate billboard space for graphics and promotional information and extending from a periphery of the flexible sheet along each opposite longitudinal edge of the flexible sheet, each panel separated by the longitudinal rows;

a line of weakness formed between the longitudinal rows, wherein the line of weakness is severable into two sub-carriers each forming a single row of container apertures with one of the two panels.

8. The flexible carrier of claim 7 wherein the line of weakness comprises a series of short perforations aligned between adjacent container apertures.

9. The flexible carrier of claim 7, wherein the container apertures are generally triangular shaped.

10. A flexible carrier for carrying a plurality of containers, the flexible carrier comprising:

a flexible sheet;

two longitudinal rows of container apertures formed in the flexible sheet, wherein a longitudinal direction extends in a machine direction of the flexible carrier;

two panels, each panel approximately as wide as each container aperture of the rows of container apertures and sized to accommodate billboard space for graphics and promotional information and formed at a periphery of the flexible sheet along each opposite longitudinal edge of the flexible sheet, the panels separated by the longitudinal rows; and a perforation extending between the longitudinal rows, the flexible carrier divisible along the perforation into two sub-carriers each forming a single row of container apertures with one of the two panels.

11. The flexible carrier of claim 10 wherein the perforation comprises a series of short perforations followed by a series of long perforations.

12. The flexible carrier of claim 10 wherein the perforation comprises a single grouping of perforations aligned longitudinally between each adjacent pair of container apertures.

13. The flexible carrier of claim 10, wherein the container apertures are generally triangular shaped.

* * * * *